United States Patent [19]

Pewitt

[11] Patent Number: 4,642,958

[45] Date of Patent: Feb. 17, 1987

[54] VENTILATED WALL AND ROOFING SYSTEM

[76] Inventor: Bernard B. Pewitt, 12115 Lantern La., Pinehurst, Tex. 77362

[21] Appl. No.: 610,879

[22] Filed: May 16, 1984

Related U.S. Application Data

[63] Continuation-in-part of Ser. No. 374,176, May 3, 1982, abandoned.

[51] Int. Cl.[4] ..... E04B 1/70

[52] U.S. Cl. ..... 52/302; 52/57; 52/90; 98/32

[58] Field of Search ..... 52/1, 302, 303, 459, 52/460, 465, 466, 404, 809, 199, 57, 90, 22; 98/32, 42 A, 42.21, 42.22

[56] References Cited

U.S. PATENT DOCUMENTS

| | | | |
|---|---|---|---|
| 2,852,109 | 9/1958 | Pine | 52/303 |
| 2,899,821 | 8/1959 | Nycander | 52/302 |
| 3,036,508 | 5/1962 | Halvorson | 98/32 |
| 3,073,235 | 1/1963 | Smith et al. | 98/32 |
| 3,537,378 | 11/1970 | Daly | 52/199 |
| 3,660,955 | 5/1972 | Simon | 52/303 |
| 3,972,164 | 8/1976 | Grange | 52/199 |
| 4,024,685 | 5/1977 | Aarons | 52/466 |
| 4,096,790 | 6/1981 | Curran | 98/32 |
| 4,098,044 | 7/1978 | Slavik | 52/503 |
| 4,214,510 | 7/1980 | Ward | 98/32 |
| 4,272,928 | 6/1987 | Schluter | 52/1 |
| 4,282,050 | 8/1981 | Thiis-Evensen | 156/71 |
| 4,295,415 | 10/1981 | Schneider, Jr. | 98/31 |
| 4,371,031 | 2/1983 | Bernander et al. | 52/303 |
| 4,406,095 | 9/1983 | Slavik | 52/404 |
| 4,467,580 | 8/1984 | Sowinski | 52/302 |
| 4,507,901 | 4/1985 | Carrol | 52/302 |

FOREIGN PATENT DOCUMENTS

| | | | |
|---|---|---|---|
| 2138074 | 2/1973 | Fed. Rep. of Germany | 52/57 |
| 1036846 | 9/1953 | France | 52/303 |
| 52736 | 3/1982 | Japan | 98/42.21 |
| 1028906 | 5/1966 | United Kingdom | 52/90 |

OTHER PUBLICATIONS

WIPO, Roof Ridge Capping System, Priority Country 25, Jun. 1982, WO 8400187, Cooper et al.

*Primary Examiner*—John E. Murtagh
*Assistant Examiner*—Andrew Joseph Rudy
*Attorney, Agent, or Firm*—Woodcock Washburn Kurtz Mackiewicz & Norris

[57] ABSTRACT

A ventilated wall and roofing having walls and roofing with vertically inclined channels there through and connected along the roof apex to a wind-powered linear vent cap arranged for primary eduction of air from said channels through slots on the entry side of said vent cap and secondary eduction of air from said channels through slots on the exit side of said vent cap when the wind blows from either direction.

5 Claims, 7 Drawing Figures

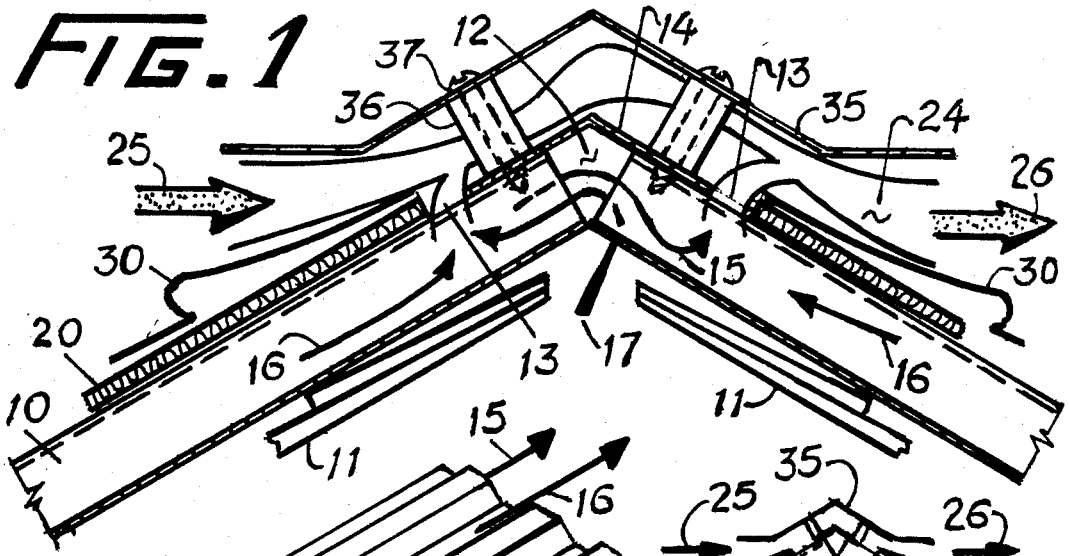
FIG. 1
12
14
37
13
36
35
24
25
26
30
15
30
20
16
13
17
16
10
11
11
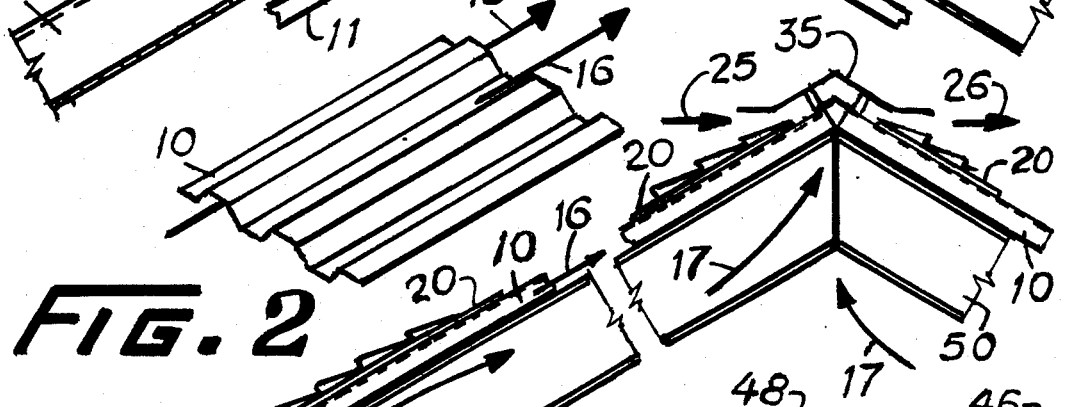
15
16
35
25
26
10
20
20
16
10
17
10
20
50
17
FIG. 2
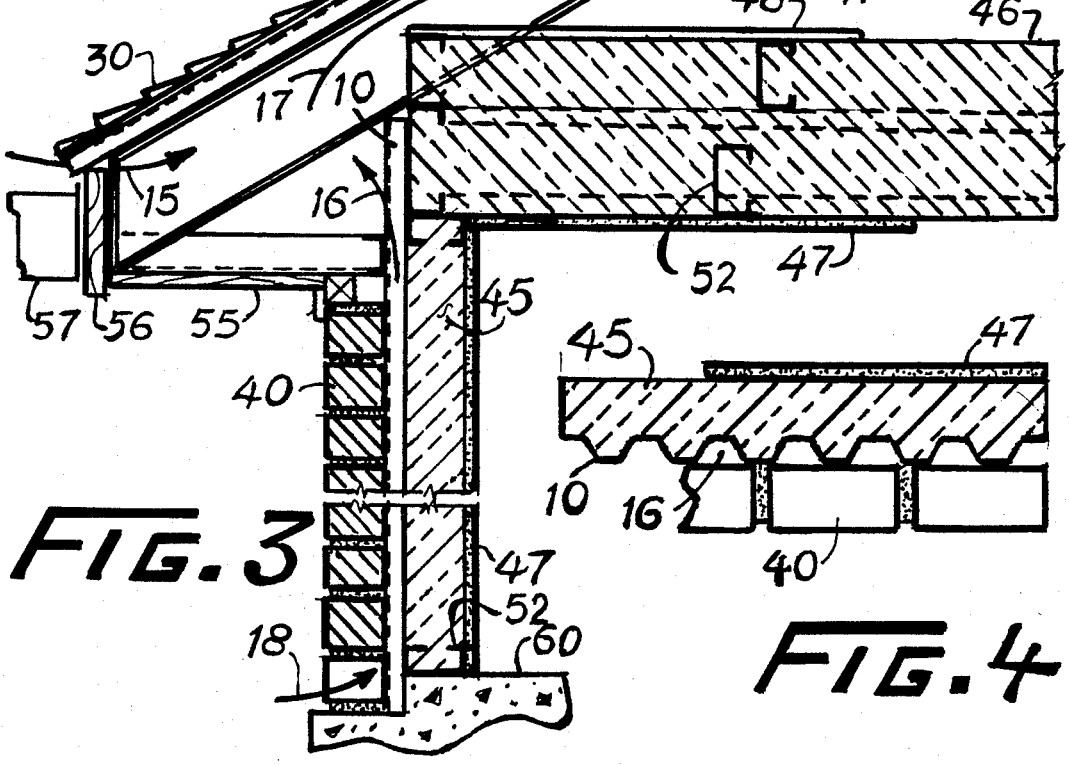
48
46
30
17
10
15
16
52
47
57
56
55
45
40
47
52
18
60
FIG. 3
45
47
10
16
40
FIG. 4

VENTILATED WALL AND ROOFING SYSTEM

BACKGROUND OF THE INVENTION

This application is a continuation-in-part of pending application Ser. No. 06/374,176 filed by me May 3, 1982 entitled "Novel Construction Assemblies", now abandoned.

This invention relates to buildings and particularly to buildings of the type having the outer walls and roof made of corrugated metal, and provides an improved construction for buildings of this type in which a heat-insulating cover is located outwardly of the metal wall and roof and the enclosed corrugated channels are arranged for the passage of ventilating air there through and exhausting to the atmosphere through a linear wind powered eductor mounted as a vent cap along the ridge line of the roof.

In buildings having the external side walls and roof made of corrugated metal, the relatively high thermal conductivity of the metal usually permits such a rapid transfer of heat from or to the interior of the building as to materially affect the usefulness of the building. In the summer season, and throughout the year in the sun belt, the hot sun shining on the building can raise the surface temperature of the metal to 190° F. and requires either excessive internal insulation or high energy costs to maintain a comfort reading of 75° F. inside the building. In addition, not many people would choose to live in a house with exposed outer corrugated metal walls and roof.

OBJECTS OF THE INVENTION

The present invention overcomes these disadvantages, and provides an improved construction for metal buildings in which a heat-insulating blanket is installed and held in place between the external cosmetic cover and the outer surface of the external corrugated metal walls and roofing, and these objects are delineated as follows:

1. The heat-insulating blanket shields the metal walls and roofing from the sun and prevents excessive temperature build-up.

2. The heat-insulating blanket also serves as a galvanic break between dissimilar metals for the application of aluminum siding or roofing as a cosmetic cover over the corrugated walls and roofing.

3. Application of the insulating blanket and cosmetic cover create ventilating channels within the finished external walls and roofing.

Since brick is considered to be a cosmetic material as well as being a poor heat conductor, another object of this invention is to use brick veneer for the outer walls against and attached to the corrugated metal, thus protecting the metal against solar heat build-up and creating ventilating channels for the circulation of cooling air through the structure and without need for the heat-insulating blanket.

Still another object of this invention is the arrangement and interconnection of the ventilating air channels so that ambient air enters along the lower extremity of the walls and along the eave line of the roof and flows upward due to heating and expansion of the air columns within the channels and exhausts to the atmosphere through the vent cap installed along the apex of the roof.

As another object of this invention, the vent cap is designed as a wind-powered linear air eductor connected to the ventilating channels within the roof and external walls and arranged to exhaust air from said channels when the wind blows from either direction.

One other object of this invention is the adaptation of this system to provide a new insulated and ventilated roof installed as a retrofit unit over an existing shingled or other type of roof enclosing an attic space and is arranged to exhaust air upwardly from the attic space as well as through the ventilating channels external to the existing roof.

Until such time as nonflammable furnishings are perfected, it will not be possible to prevent the starting of fires in hotel rooms, apartments and residences, but it is an object of this invention to prevent the spread of such a fire beyond the point of origin by utilizing fireproof construction materials and encapsulating all flammable insulation within the structure.

In addition to the built-in-place air eductor that is an integral part of roof and wall ventilating system, a final object of this invention is to provide a completely assembled wind-powered ridge vent eduction unit that can be installed and nailed in place by the homeowner to exhaust air from the attic space. Heated air will rise naturally and exit through the eduction unit, but during cold weather the wind-powered eduction unit will maintain sufficient air flow through the attic space to prevent the condensation of moisture and consequent dripping of water within the attic space.

SUMMARY OF THE INVENTION

This invention can be summarized as an improvement in metal buildings whereby the living quarters inside are superinsulated and fireproofed, the external metal surface of the corrugated walls and roof is covered with a heat-insulating blanket and cosmetic siding and roofing thus creating air channels there through which are connected to a wind-powered air eductor installed as a vent cap along the roof gable and arranged to exhaust air hrough the walls, roofing and attic space when the wind blows from either direction. In addition, of course, convection air currents will rise as the internal air space is heated by solar energy above the temperature of the external environment and this heated air will also exit through the vent cap.

BRIEF DESCRIPTION OF THE DRAWINGS

FIG. 1 is an enlarged cross-section of the roof gable shown in FIG. 3 and illustrates the mechanics of the wind-powered air eductor and the arrangement for the eduction of air from air channels and attic space.

FIG. 2 is an isometric view of a corrugated metal sheet and illustrates the location of inner and outer channels when installed within the external walls and roofing.

FIG. 3 is a vertical cross-section through a house and shows the metal building with corrugated metal walls and roofing, the super insulated and fireproofed interior, and the cosmetic covering external to the corrugated metal walls and roofing. The cooling air channels are shown as well as the direction of air flow through the structure.

FIG. 4 is a plan view cross-section of the external wall disclosed in FIG. 3.

DESCRIPTION OF PREFERRED EMBODIMENTS

Figure 5:
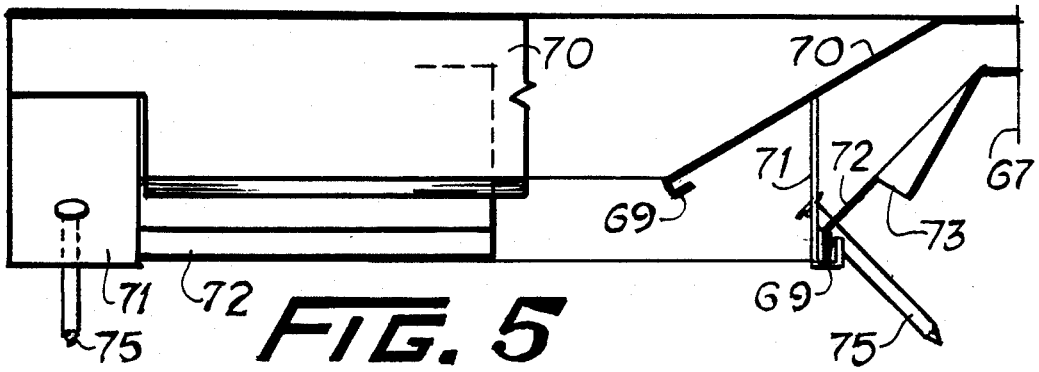
FIGS. 5, 6 and 7 illustrate fabrication and assembly details of the wind-powered eduction unit arranged for retrofit installation or new roof construction.

Referring now to the drawings and more particularly to FIG. 1 which illustrates the principles of fluid mechanics utilized in my invention for primary and secondary vacuum eduction of air from ventilating channels 15 and 16 and attic space 17 into the wind stream 24 entry 25 and exit 26. Since the design is a mirror image when viewed from the center line, the wind stream force diagram 24 will be reversed when the wind 25 blows from the opposite direction. Implementation of my design is as follows: Opposing corrugated metal sheets 10 are abutted at the roof gable line and are attached either to existing roofing 11 for a retrofit application or to supporting members 50 for new construction. The baffle plate 14 is attached along the apex to opposing corrugated metal sheets 10. The baffle plate 14 has a three-fold function: (1) creates an annular air space 12 that is common to air channels 15 and 16 as well as the attic air space 17; (2) serves as a deflector to divert the ar stream 25 upward as shown in the air stream force diagram 24, and (3) diverts wind-driven rain into air channel 16 for gravity flow off the building, thus preventing entry into the attic space through air passage 17. Next, the heat-insulating blanket 20 and the aluminum roof 30 are installed and spaced apart from the baffle plate 14 to form identical eductor slots 13 on each side of the roof E. The vent cap 35 is installed and spaced apart from the baffle plate 14 by using screws 37 and spacers 36. Any increase in the thickness of the heat-insulating blanket 20 will be compensated by increasing the length of the spacers 36 by a corresponding amount.

Now, in operation, the wind stream force diagram 24 is utilized to show the direction and location of the air stream through the assembly, divergence of lines indicate a decrease in velocity of the air stream as at the exit 26, and convergence of lines indicate an increase in air velocity as at the entry 25. Thus wind blowing into the venturi-throated entry 25 is compressed causing some increase in velocity for more efficient vacuum. Eduction of air from the channels 15, 16 and 17 through the eductor slot 13 and into the air stream 24 is deflected upward by striking the baffle plate 14 and then is forced abruptly downward by the under surface of the vent cap 35 causing the effect of aerodynamic lift with consequent negative air pressure below the air stream and secondary eduction of air from channels 15, 16 and 17 through the eductor slot 13 and into the air stream 24 on the exit side 26 of the assembly.

FIG. 2 is an isometric view of the corrugated metal 10 and is shown to identify the orientation of channels 15 and 16.

FIG. 3 is a cross-sectional view through a metal building having corrugated metal roofing 10 and external walls 10. Fireproof interior finish of the building is as follows: after installation of metal framing for doors and windows, the wall cavity 45 is filled flush with the interior surface of the framing members 52 with sprayable urethane foam having an R-value of 25 for a 3½" thickness. Firegrade gypsum board 47 is attached to wall framing members 52 and completes the internal wall. Since more space is available within the attic, a cheaper and less efficient fiberglass insulation 46, requiring a 10-inch thickness for a R-value of 40, is used for the ceiling to attic closure. Firegrade gypsum board 47 is installed at the ceiling line and plywood flooring 48 is installed above to encapsulate the fiberglass insulation 46. For the exterior wall, brick is installed in the conventional manner and anchored to the outer face of the corrugated metal wall with weepholes arranged in the first brick course for egress of condensation and entry of cooling air 18 which rises as the temperature increases within the wall and exits through air channels 16 into the soffit and attic space above. The soffit enclosure 55 and fascia 56 seal the eave and the roof drain 57 is shown in position for attachment to the fascia 56. Cooling air also enters the soffit area through air channels 15 along the underside of the corrugated roofing 10 at the eave line and solar induced heating within the attic space causes rising air currents 15, 16 and 17 throughout the structure which continue to rise and exit the building as long as the air temperature within the attic is above the temperature of outside ambient air. When the wind blows, additional air is pumped through the structure as already described and, in addition, through the air channel 16 for a new roof installation and through both air channels 15 and 16 for a retrofit installation for direct cooling of wall and roofing corrugated sheets 10.

FIG. 4 is a plan sectional view of the wall shown in FIG. 3 and illustrates the usage of the corrugated metal wall 10 for fireproof containment of urethane insulation 45 as the inner wall sealed with firegrade gypsum board 47, and the arrangement of the brick 40 outer wall with enclosure of the air channels 16 for the passage of cooling air upward through the structure.

FIG. 5 is a combined cross-section and elevation of the wind-driven eductor assembly along the centerline 67 and shows the outer cover 70 with the standing seam 69 on the outer extremity and the ear section 71 folded down to connect the inner cover 72 having a series of ventilating slots 73 and held in place with installation nails 75.

Figure 6:
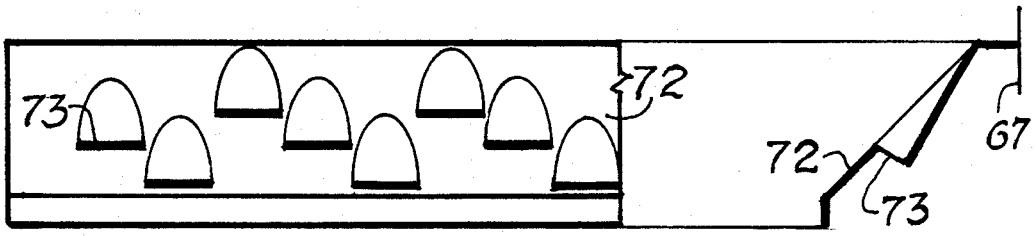

FIG. 6 is a combined cross-section and elevation of the lower cover 72 along the centerline 67 and shows the arrangement of the perforated slots 73 for the passage of vacuum educted air there through.

Figure 7:
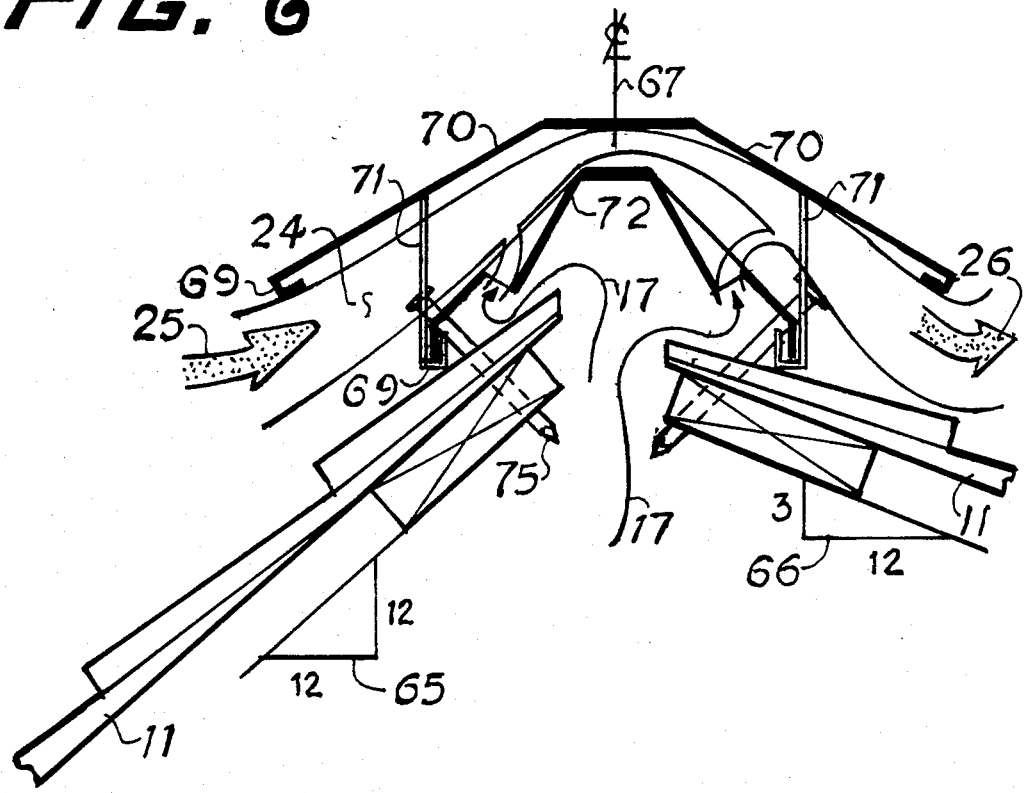

FIG. 7 is a cross-sectional view and shows the wind-driven eductor of FIGS. 5 and 6 mounted on the roof 11 gable wherein the roof slope may vary from a 12/12 slope 65 to a 3/12 slope 66 and is held in place with nails 75. Entry wind 25 blows into the unit between the outer cover 70 and the inner cover 72 and is confined generally within the limits of the force diagram 24 being deflected upward by the inner cover 72 to the apex at the centerline 67 and then downward by the outer cover to the wind exit 26. The confined wind flow thus described through the unit causes direct eduction of attic air 17 through slots 73 into the windstream 24 on the entry side 25 and indirect eduction of attic air 17 through the slots 73 due to the airplane wing lift effect and consequent negative pressure area on the wind exit side 26. The eductor unit is constructed as a mirror image about the centerline 67 and a reversal of wind direction will change FIG. 7 from a left-hand thumb entry as shown to a right-hand thumb entry; i.e., a mirror image.

While the preferred embodiment of the invention has been herein illustrated and described, it will be understood that the invention may be embodied in other forms within the scope of the following claims.

Having thus described the invention, what is claimed is:

1. A system for ventilating a building space comprising:

upwardly sloping, corrugated roofing members on the building extending from a lower portion of the building to an apex;

roofing material covering the corrugated roofing members and spaced apart therefrom to form air channels extending from a lower portion of the building to the apex;

air eduction means located at the apex comprising:

a baffle plate on an upward portion of the corrugated roofing members;

an outer cover disposed over but spaced away from the baffle plate to form an annular air space therebetween open to the atmosphere; and openings communicating with the air channels and the annular air space;

said annular air space being configured to provide a partial vacuum at at least some of said openings upon the passage of atmospheric wind through the annular air space to cause eduction of air from the air channels through at least some of the openings and into the atmosphere.

2. The system of claim 1 further comprising wall air channels in at least one wall of the building in pneumatic contact with the said air channels such that the eduction of air includes passage of the air through the wall air channels.

3. The system of claim 1 wherein the annular air space is configured at least partially into a venturi shape having an entrance and an exit end.

4. The system of claim 3 wherein the annular air space is further configured to have an abrupt downward slope adjacent the exit end of the venturi shape.

5. The system of claim 2 wherein the air channels are pneumatically in communication with an attic space of the building.

* * * * *